United States Patent [19]

LaRocca et al.

[11] Patent Number: 4,986,186

[45] Date of Patent: Jan. 22, 1991

[54] HIGH PEAK PRESSURE NOTCHED CARTRIDGE CASE.

[75] Inventors: Edward W. LaRocca, Placentia; Norman H. Andersson, Rancho Cucamonga, both of Calif.

[73] Assignee: General Dynamics Corporation Air Defense Systems Division, Pomona Facility, Pomona, Calif.

[21] Appl. No.: 265,747

[22] Filed: Nov. 1, 1988

[51] Int. Cl.[5] ..... F42B 5/26

[52] U.S. Cl. ..... 102/464; 102/430; 102/469

[58] Field of Search ..... 102/430, 437, 464–469

[56] References Cited

U.S. PATENT DOCUMENTS

| | | | |
|---|---|---|---|
| 602,875 | 4/1898 | Ross . | |
| 1,103,202 | 7/1914 | Hoagland . | |
| 1,103,203 | 7/1914 | Hoagland . | |
| 2,931,039 | 4/1960 | Henning et al. | 102/464 |
| 3,261,291 | 7/1961 | Woodring et al. | 102/466 |
| 3,609,904 | 10/1971 | Scanlon | 102/466 |
| 3,808,974 | 5/1974 | Herter | 102/466 |
| 3,948,178 | 4/1976 | Luther et al. . | |
| 4,233,903 | 11/1980 | Lage | 102/466 |
| 4,681,038 | 7/1987 | Washburn . | |
| 4,738,202 | 4/1988 | Hebert | 102/464 |

FOREIGN PATENT DOCUMENTS

| | | | |
|---|---|---|---|
| 13425 | of 1885 | United Kingdom | 102/464 |
| 13742 | of 1910 | United Kingdom . | |

*Primary Examiner*—Harold J. Tudor

*Attorney, Agent, or Firm*—Henry Bissell; Leo R. Carroll

[57] ABSTRACT

A notched cartridge or casing is provided to mitigate the shock damage to a gun barrel or firing chamber when a cartridge with large amounts of explosive or propellant is fired. The cartridge or casing comprising a generally cylindrical shell with an open top end and a closed base is provided with an annular area near the base and a circular area on the base which have reduced wall thicknesses compared to the rest of the cartridge. The annular and circular areas have external surfaces which are inwardly displaced with respect to the outer surface of the remainder of the cartridge. Upon firing of the cartridge, the areas of reduced wall thickness expand outwardly and are plastically deformed without touching the barrel or firing chamber. Damage to the barrel and/or breech is prevented and the cartridge is easily removed for reloading of the gun system.

5 Claims, 1 Drawing Sheet

HIGH PEAK PRESSURE NOTCHED CARTRIDGE CASE

BACKGROUND OF THE INVENTION

1. Field of the Invention.

The present invention relates to methods of handling high peak pressures or shock waves in a firing chamber or gun barrel having a strength designed for a lower pressure or load and, more particularly, to a notched cartridge case that can be fired without harmful effects in such a firing chamber or gun barrel.

2. Description of the Related Art

When an explosive charge, propellant, or similar material is initiated, ignited, burned, detonated, or reacted in a closed or restricted case, container, or cavity, shock and/or pressure waves are produced which cause an unreinforced case, container, or cavity to bulge, swell, stretch, or otherwise be deformed if the loads exceed the elastic limits of the container material.

The strength of a cartridge case is tested most severely during firing. The pressure of the expanding gas imposes severe stresses on the cartridge case, and the case must be able to withstand the stresses without rupturing or being distorted to the extent that extraction of the case from the weapon is impeded. Another important factor in extraction, particularly in the case of automatic weapons having a high rate of fire, is elastic recovery of the cartridge case after firing. The case may be distorted for a brief tie measured in small fractions of a second at the moment of burning or detonation of the charge. It is vital that the case recover from distortion to its original size very rapidly if the case is to be easily extracted from the chamber as soon as the cartridge is fired.

In normal cartridge cases or containers, the chamber pressures are controlled by appropriate design of the reacting materials, the case or container, and the outer case, cavity, or tube. These designs are usually intended to provide a case which can be readily removed after functioning and replaced with another unit. This requires that no permanent deformation occur to the outer case, cavity, or barrel.

In certain outer cases, cavities, or barrels where peak design loads are low, maximum loads in the cases or containers used are accordingly limited. It would be an advance in the art of munitions and ordnance if there were a way to provide for a high-load output while using a relatively weak outer case.

Some related patents are described below.

U.S. Pat. No. 602,875 to Ross relates to a cartridge shell having a groove or depression around the side of and/or in the base of the shell with perforations in said grooves to allow air to communicate with the interior of the shell. The disclosed purpose is to increase the combustion and to more thoroughly consume the powder and its constituent gases before the latter leave the gun.

British patent No. 13,742 to Krnka is directed to forming the body of a bottle-shaped cartridge case with a circumferential groove to allow it to elongate, and with two or more grooves arranged transversely to the circumferential groove to allow the case to expand crosswise for the purpose of preventing the case from splitting transversely and longitudinally. The allowed elongation provides a rearward movement to an unlocking piece in the bolt or gun action and provides energy for unlocking the action.

U.S. Pat. No. 1,103,202 to Hoagland relates to a cartridge case design providing a "weakened" area whereby expansion of the cartridge case provides a gas seal to the rear of the cartridge case. The stretching of the wall of the shell is effected by forming longitudinal grooves or corrugations, and the cartridge design is also intended to prevent sticking of the shell in the chamber due to expansion of the case mouth into an eroded area of the barrel.

U.S. Pat. No. 1,103,203, also to Hoagland, is directed to a rimfire cartridge case design having a plurality of series of depressions near the head of the shell which stretch upon firing and leave expanding rings between contiguous series of depressions. The rings are forced into contact with the wall of the chamber back of where erosion ordinarily takes place.

U.S. Pat. No. 3,948,178 to Luther relates to a propellant-charge cartridge case comprising a stub which has a wall and at least one part provided with a resilient gas check which can be pressed against a barrel wall. The cartridge-case wall is formed with a annular groove cut from the outside to weaken the cross section of the wall. A resilient insert fills the annular groove so that as the gas pressure builds up within the case upon firing, the case stub is deformed in the region of the annular groove to reduce the size thereof and squeeze the insert out of the annular groove in a gas-sealing manner against the barrel wall.

U.S. Pat. No. 4,681,038 to Washburn is directed to an ammunition round cartridge case having a stress riser in the form of at least one elongated recess adapted for preserving the seal of ignition gases within the cartridge case during initial stages of the ignition and also adapted for allowing a splitting of the cartridge case wall surface at peak pressure during firing. The purpose is to permit easy extraction or push-through ejection of the cartridge case from the gun chamber subsequent to firing of the round. A preferred embodiment utilizes a unitary recess parallel to the longitudinal axis of the cartridge case, longer than one-half of the length and having a triangular cross section, the apex of which extends more than halfway into the wall surface of the case.

None of the patents summarized above provides solutions to the problems described at the beginning of this section.

SUMMARY OF THE INVENTION

In accordance with the present invention, a notched cartridge or casing is provided to mitigate the shock damage to a gun barrel or firing chamber when a cartridge with large amounts of explosive (or propellant) is fired. A cartridge or casing comprising a generally cylindrical shell with an open top end and a closed base is provided with an annular area near the base and a circular area on the base, both of which have reduced wall thicknesses compared to the rest of the cartridge. The annular and circular areas have external surfaces which are inwardly displaced with respect to the outer surface of the remainder of the cartridge. When the cartridge is fired or has its explosive detonated, the areas of reduced wall thickness expand outwardly and are plastically deformed. By proper choice of the wall thicknesses and the extents of the annular and circular areas, the permanent outward expansion of the thinner-walled areas can be prevented from touching the barrel walls after the cartridge is fired. In this event, the cartridge is easily removed for reloading of the gun system. Also, damage to the barrel and/or breech is prevented.

BRIEF DESCRIPTION OF THE DRAWINGS

A better understanding of the present invention may be realized from a consideration of the following detailed description, taken in conjunction with the accompanying drawing in which.

DESCRIPTION OF THE PREFERRED EMBODIMENT

The general purpose of the invention is to mitigate the shock damage applied to a cartridge casing when large amounts of explosive (or propellant) are detonated or ignited. The shockwave from a detonation of high explosive typically induces an impulse to the cartridge that is beyond the elastic and plastic stress limits of conventional materials such as brass, aluminum, and steel. Permanent deformation of a cartridge case or container can occur also through pressure alone or by a combination of pressure and shockwave. Such permanent deformation commonly interferes with the easy and rapid ejection or withdrawal of the container from the gun.

Figure 1:
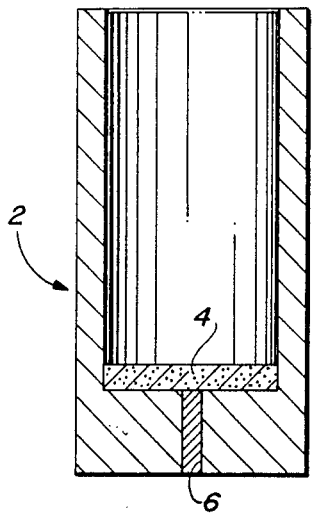
FIG. 1 (PRIOR ART)
FIG. 1 is a schematic drawing in cross section of a conventional cartridge case or container before firing or functioning.
Figure 2:
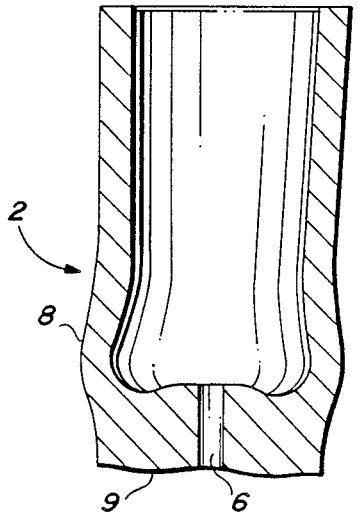
FIG. 2 (PRIOR ART)
FIG. 2 is a schematic drawing in cross section of a conventional cartridge case or container after firing function.

FIG. 1 shows a conventional case or container 2, the bottom of which is filled with an explosive or reactant material 4 above a detonator or triggering device 6. FIG. 2 shows case or container 2 after the explosive charge 4 has been set off by detonator 6. Substantial permanent deformation of case 2 from its original shape occurs, especially in regions 8 and 9. This deformation is generally nonconducive to successful successive firings of the gun. The deformation causes damage to the breech and/or barrel that in minor cases causes a lack of accuracy and in major cases results in destruction of the breech or barrel.

Generally, the use of material to absorb the shock impulse prior to the shockwave hitting the barrel wall is impractical. Sufficient material to preclude deformation of the sidewall presents an unacceptable solution in the case of small-caliber cartridges. In accordance with the present invention, it was found that by reducing the outer diameter of the cartridge case by routing a chamfer that was several thousandths of an inch deep, acceptable deformation could occur which would still allow easy removal of the cartridge for reloading of the gun system.

Figure 3:
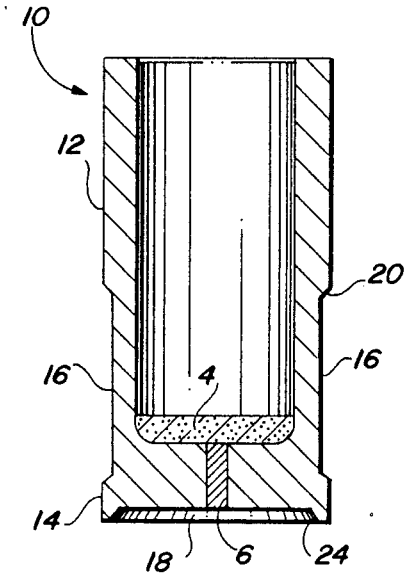
FIG. 3 is a schematic drawing in cross section of a notched cartridge case in accordance with the present invention.

As shown in FIG. 3, a notched cartridge case 10 in accordance with the present invention comprises a generally cylindrical shell 12 having a first wall thickness and a base 14 through which detonator 6 communicates with an explosive or propellant charge 4 in the interior of the cartridge. An inwardly displaced circumferential portion 16 near base 14 has a reduced wall thickness. A depressed circular area 18 in base 14 similarly defines a region of reduced base thickness. Beveled regions 20 and 22 border circumferential region 16, and circular bevel 24 surrounds depressed region 18 in base 14.

Figure 4:
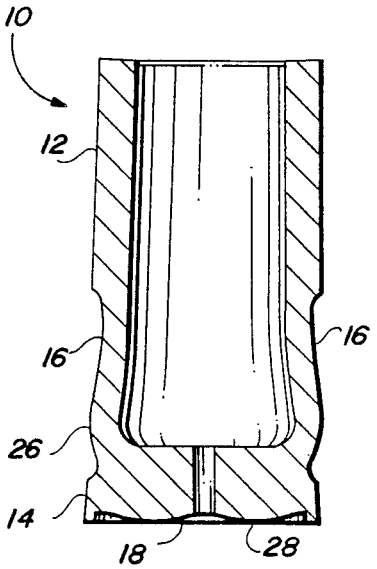
FIG. 4 is a schematic drawing in cross section of a notched cartridge case after firing.

FIG. 4 shows the effects of explosive propellant 4 having been detonated or ignited. Permanent outward deformation has taken place in the circumferential area 16 and in the circular depressed area 18. In particular, a circumferential bulge 26 and a roughly circular bulge 28 have appeared. However, neither bulge 26 nor bulge 28 extends beyond the cylindrical volume defined by the outer diameter and overall length of shell 12. The absence of material in the regions 16 and 18 has allowed room for expansion and plastic deformation of the sidewall and base into the spaces provided by the design. As a consequence, damage to the barrel in which notched cartridge 10 is fired is prevented. The cartridge can be readily removed after it has been fired and can be replaced with another unit. By use of a notched cartridge case 10 in accordance with the present invention it is possible to use a high peak pressure propellant or high load output explosive in the cartridge, which would not be possible in a conventional cartridge case having a uniform sidewall thickness and base thickness.

An important feature of the present invention is that structurally weakened portions of the cartridge casing be allowed to expand and become plastically deformed within the outermost contour of the cartridge shell and base. Various other shapes and configurations of shell 12 and base 14 can be envisioned besides the embodiment shown in FIG. 3. The chamfers 20 and 24 are important for reducing the stress concentrations in these regions.

Although there has been described above one specific arrangement of a notched cartridge case in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention a defined in the annexed claims.

What is claimed is:

1. A cartridge case for use in conjunction with a firing chamber having an inner bore comprising:

a generally cylindrical shell having a hollow cylindrical portion open at a top end and joined to a closed base, said shell having a maximum outer diameter which fits said inner bore of said firing chamber, and a circumferential portion defining a structurally weakened segment with an inwardly displaced outer surface which overlaps both said base and said hollow cylindrical portion, said inwardly displaced outer surface forming a space surrounding the shell within said maximum diameter, said structurally weakened segment being deformable plastically into said space, said space being sufficient to allow outward plastic deformation of material of said structurally weakened segment without said outward deformation exceeding said maximum outer diameter when the cartridge is detonated;

said circumferential portion in the region of overlap with the hollow cylindrical portion having a uniform wall thickness that is less than the wall thickness of the remainder of said hollow cylindrical portion; and said circumferential portion being bounded by upper and lower circumferential strips adjoining said circumferential portion and sloping from said maximum outer diameter to a smaller outer diameter of said circumferential portion.

2. The cartridge case of claim 1 wherein said circumferential portion is generally cylindrical.

3. The cartridge case of claim 1 wherein an end surface of said base has an inwardly displaced area.

4. The cartridge case of claim 3 wherein said inwardly displaced area is circular, centrally located, and surrounded by a circular rim extending about the periphery of said base end surface.

5. The cartridge case of claim 11 wherein said hollow cylindrical portion has a substantially constant inner diameter and a nonuniform wall thickness which is reduced in the region of overlap with the cylindrical portion relative to a wall thickness of a remaining sidewall portion of said shell.

* * * * *